US008400246B2

(12) United States Patent
Ono

(10) Patent No.: US 8,400,246 B2
(45) **Date of Patent: *Mar. 19, 2013**

(54) COIL COMPONENT, REACTOR, AND METHOD FOR FORMING COIL COMPONENT

(75) Inventor: Hiroshi Ono, Kariya (JP)

(73) Assignee: Kabushiki Kaisha Toyota Jidoshokki, Aichi (JP)

( * ) Notice: Subject to any disclaimer, the term of this patent is extended or adjusted under 35 U.S.C. 154(b) by 25 days.

This patent is subject to a terminal disclaimer.

(21) Appl. No.: 13/103,639

(22) Filed: May 9, 2011

(65) Prior Publication Data

US 2011/0279208 A1 Nov. 17, 2011

(30) Foreign Application Priority Data

May 14, 2010 (JP) ..... 2010-112644

(51) Int. Cl.
*H01F 27/29* (2006.01)

(52) U.S. Cl. ..... 336/192

(58) Field of Classification Search ..... 336/65, 336/192, 180–184, 220–223
See application file for complete search history.

(56) References Cited

U.S. PATENT DOCUMENTS

| | | | | |
|---|---|---|---|---|
| 6,927,660 | B2 * | 8/2005 | Okamoto | 336/192 |
| 7,427,909 | B2 * | 9/2008 | Ono et al. | 336/90 |
| 2011/0156853 | A1 * | 6/2011 | Kato et al. | 336/192 |

FOREIGN PATENT DOCUMENTS

| | | | |
|---|---|---|---|
| JP | 3737461 | B2 | 2/2004 |
| JP | 2007-305803 | A | 11/2007 |

* cited by examiner

*Primary Examiner* — Tuyen Nguyen
(74) *Attorney, Agent, or Firm* — Sughrue Mion, PLLC

(57) ABSTRACT

A coil component comprises a plurality of coil elements arranged side-by-side and a connecting portion that interconnects the coil elements. The plurality of coil elements are formed from a single flat wire wound edgewise so that the coil elements wind in the same direction and have rectangular annular configurations. The connecting portion includes a portion of the flat wire between the two coil elements wound edgewise to protrude radially outward from two adjacent sides of the rectangular annular configurations of the coil elements, and bent flatwise at three positions including a turnover so that the two coil elements are arranged side-by-side with their axes in parallel with each other.

8 Claims, 10 Drawing Sheets

COIL COMPONENT, REACTOR, AND METHOD FOR FORMING COIL COMPONENT

TECHNICAL FIELD

The present invention relates to a coil component, a reactor, and a method for forming a coil component.

BACKGROUND

As a coil component, a technique for forming two coil elements using a single flat wire is disclosed in Japanese Patent No. 3737461 and Japanese Laid-open Patent Publication No. 2007-305803. Specifically, in Japanese Patent No. 3737461, two coil elements having offset axes are formed by winding a single flat wire edgewise. In Japanese Laid-open Patent Publication No. 2007-305803, the winding directions of right and left coil elements are opposite, i.e., after a single flat wire is wound to form a first coil element in one direction, a necessary length of the flat wire for forming a second coil element is sent forth and wound back in an opposite direction to form a second coil element.

SUMMARY OF THE INVENTION

As in Japanese Patent No. 3737461, in the case where two coil elements are formed by offsetting their axes while a single flat wire is wound edgewise, increasing the speed is difficult since offsetting of the axes is required and swing of the flat wire while coiling becomes great.

As in Laid-open Patent Publication No. 2007-305803, after a single flat wire is wound to form a first coil element, a necessary length of the flat wire for forming a second coil element is sent forth. Coiling of the second elements is conducted after the necessary length of the flat wire is all pulled out. This adds time when distance between the two coil elements is great. In addition, a first coil element swings during the time when the second coil element is coiled. This makes increasing the coiling speed difficult. Moreover, since the winding directions of the two coil elements are opposite, two kinds of winding heads are required.

An object of the present invention is to provide a coil component that can be processed easily when a plurality of coil elements that are arranged side-by-side are formed from a single flat wire, a reactor, and a method for forming a coil component.

According to a first aspect of the invention, a coil component is provided. The coil component comprises a plurality of coil elements arranged side-by-side and a connecting portion that interconnects the coil elements. The plurality of coil elements are formed from a single flat wire wound edgewise so that the coil elements wind in the same direction and have rectangular annular configurations. The connecting portion includes a portion of the flat wire between the two coil elements wound edgewise to protrude radially outward from two adjacent sides of the rectangular annular configurations of the coil elements, and bent flatwise at three positions including a turnover so that the two coil elements are arranged side-by-side with their axes in parallel with each other.

According to a second aspect of the invention, a method for forming a coil component is provided. The method comprises winding a flat wire edgewise around a single axis so that a plurality of coil elements are formed and wound in the same direction having rectangular annular configurations and a connecting portion interconnecting the two coil elements protrudes radially outward from two adjacent sides of the rectangular annular configurations of the coil elements; and after winding the flat wire edgewise, bending the connecting portion flatwise at three positions including a turnover so that the two coil elements are arranged side-by-side with their axes in parallel with each other.

DETAILED DESCRIPTION OF THE PREFERRED EMBODIMENTS

A first embodiment of the present invention will be described below with reference to the drawings.

Figure 1:
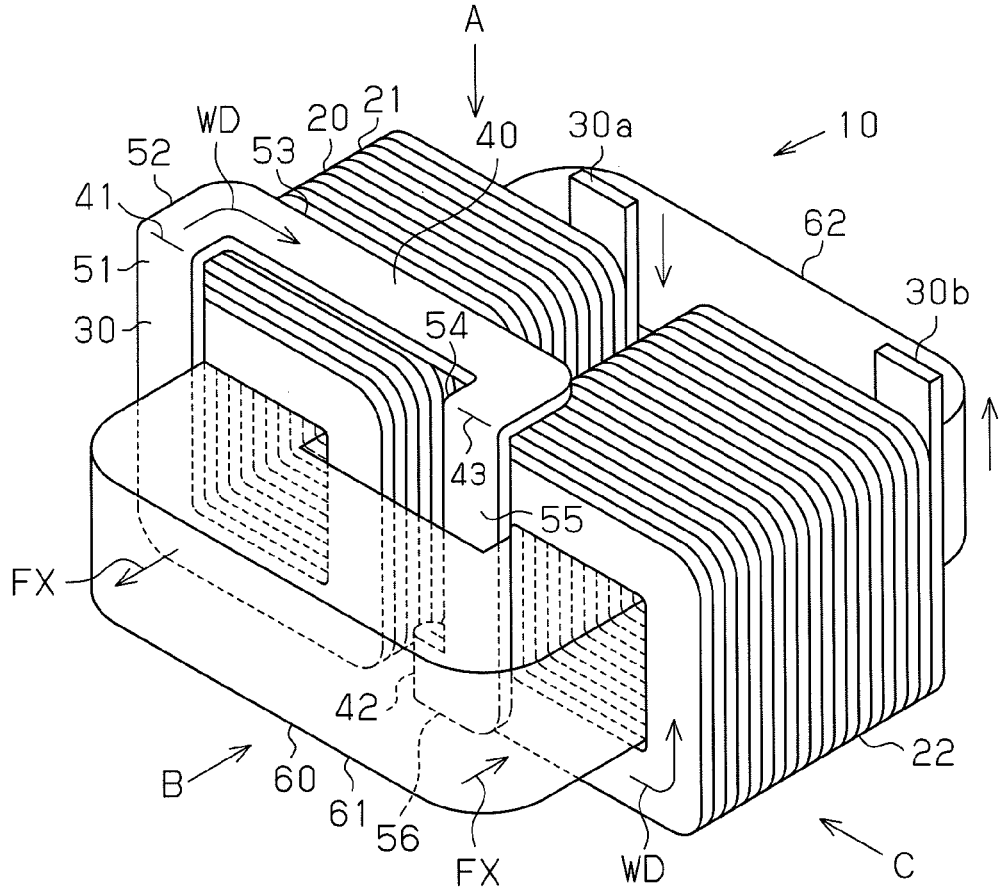
FIG. 1 is a perspective view of a reactor in accordance with a first embodiment.
Figure 2A:
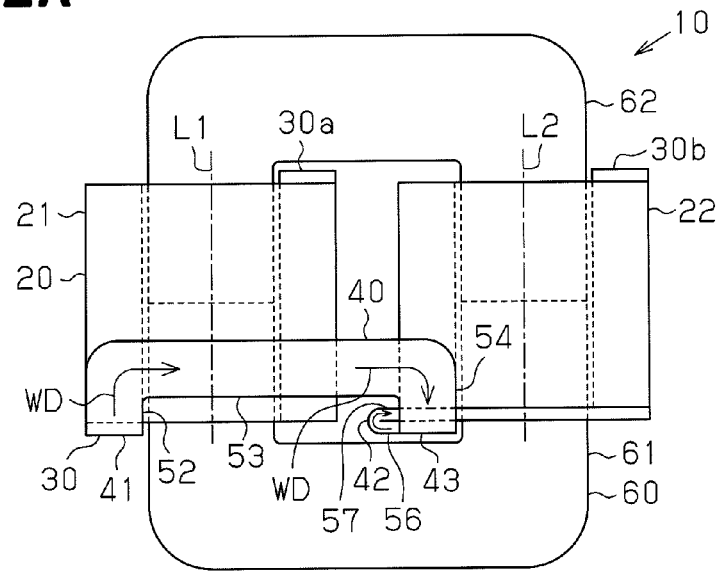
FIGS. 2A to 2C are a plan view, a front view, and a side view of the reactor of FIG. 1.
Figure 2B:
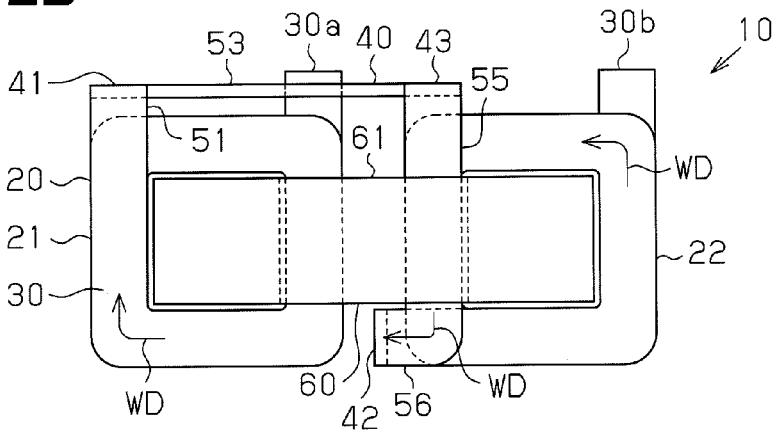
Figure 2C:
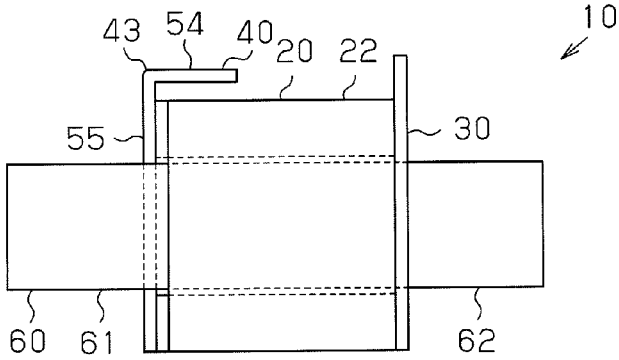

FIG. 1 illustrates a perspective view of a reactor 10 in accordance with the first embodiment. FIGS. 2A, 2B and 2C illustrate a plan view (viewed in the direction of the arrow A in FIG. 1), a front view (viewed in the direction of the arrow B in FIG. 1) and a side view (viewed in the direction of the arrow C in FIG. 1) of the reactor 10 in FIG. 1, respectively. Throughout the drawings, the arrow FX denotes density of magnetic flux of a coil element 21 or 22 and the arrow WD denotes the winding direction of a flat wire 30.

The reactor 10 includes a coil component 20 and a UU-type core 60. The UU-type core 60 is comprised of a U-type core 61 and a U-type core 62. The U-type core 61 has a rectangular cross-sectional area, and is U-shaped when viewed in plan view as in FIG. 2A. Similarly, the U-type core 62 also has a rectangular cross-sectional area, and is U-shaped when viewed in plan view as in FIG. 2A. Both end faces of the U-type core 61 contact both end faces of the U-type core 62.

Of the coil component 20, a rectangular annular coil element 21 is wound around one of the contact faces of the U-type core 61 and the U-type core 62, and a rectangular annular coil element 22 is wound around the other of the contact faces of the U-type core 61 and the U-type core 62.

Figure 3:
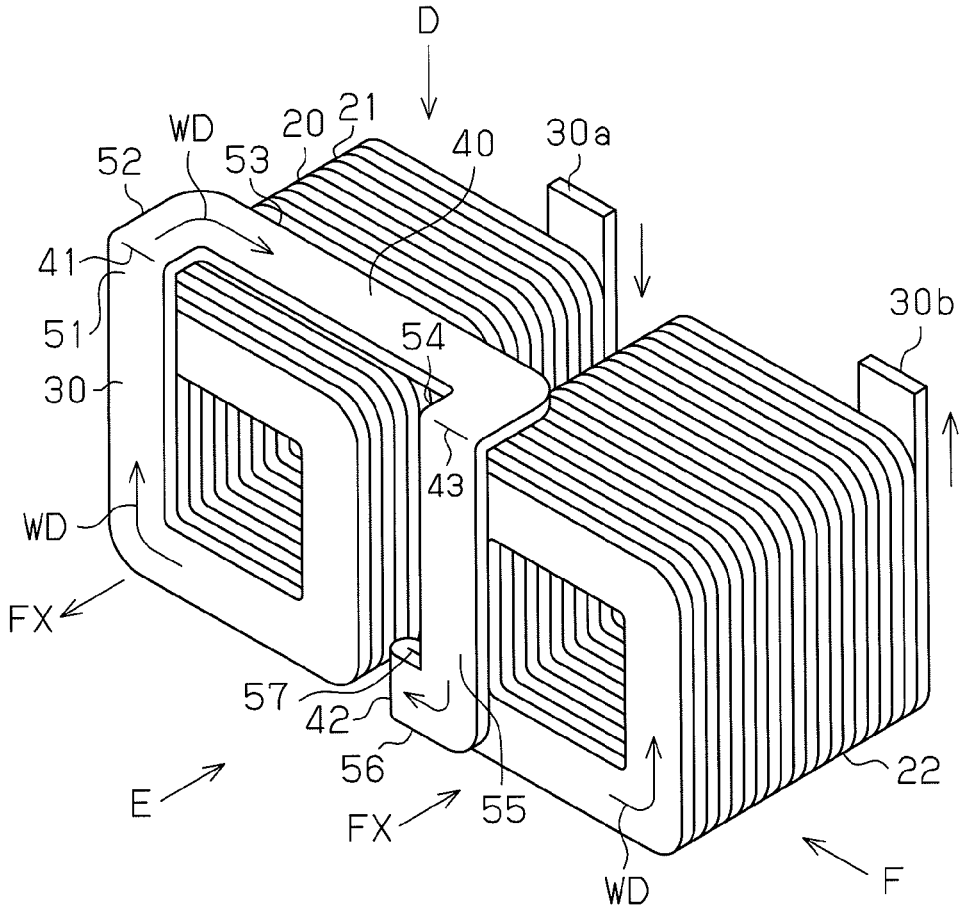
FIG. 3 is a perspective view of a coil component.
Figure 4A:
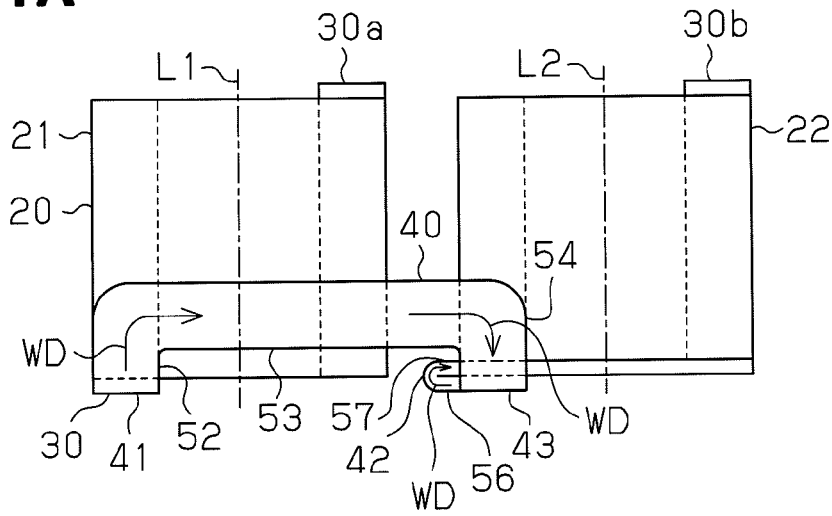
FIGS. 4A to 4C are a plan view, a front view, and a side view of the coil component of FIG. 3.
Figure 4B:
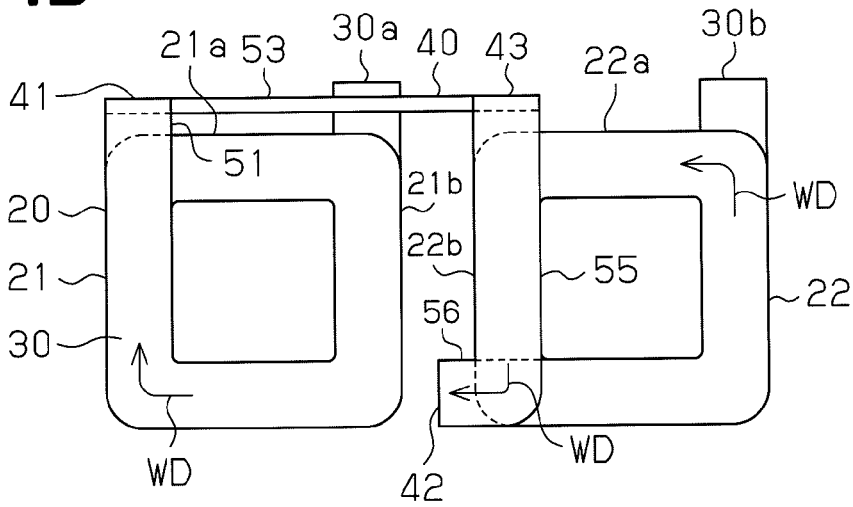
Figure 4C:
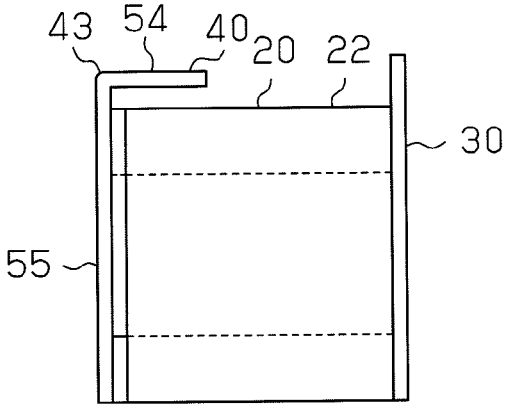

FIG. 3 illustrates a perspective view of the coil component 20. FIGS. 4A, 4B and 4C illustrate a plan view (viewed in the direction of the arrow 4A in FIG. 3), a front view (viewed in the direction of the arrow 4B in FIG. 3) and a side view (viewed in the direction of the arrow 4C in FIG. 3) of the coil component 20 in FIG. 3, respectively.

As already described with reference to FIG. 2, the coil component 20 includes the first coil element 21 and second coil element 22. The first coil element 21 has a rectangular annular configuration and the second coil element 22 has a rectangular annular configuration. The axial line of the coil element 21 is denoted as L1 and the axial line of coil element 22 is denoted as L2 (See FIG. 4A).

Figure 5:
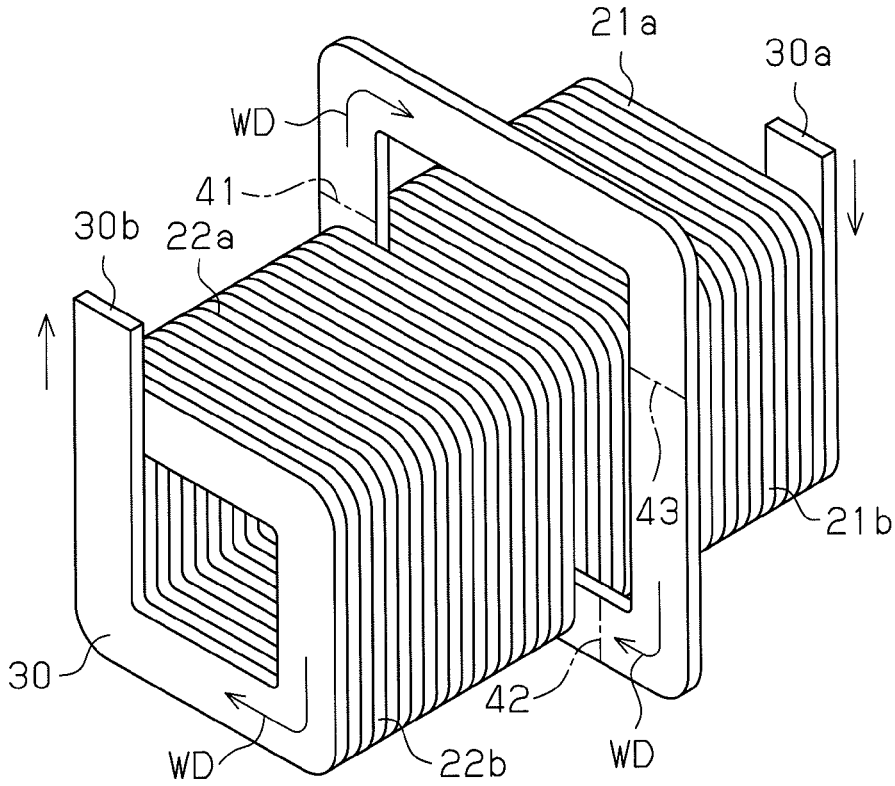
FIGS. 5 to 7 are perspective views illustrating steps of forming the coil component of FIG. 3.

The first coil element 21 and the second coil element 22 are arranged side by side with each other. The first coil element 21 and the second coil element 22 are formed by winding a flat wire 30 having a rectangular cross-sectional area in an edgewise way. The winding directions for the first and second elements 21 and 22 are the same. Specifically, as illustrated in FIG. 5, the flat wire 30 is wound edgewise around a single axis before the two coil elements 21 and 22 are formed. The flat wire 30 is made of copper. As used herein, the term "edgewise winding" refers to winding around the shorter side of the longitudinal cross-sectional area of the flat wire.

As illustrated in FIG. 3, the coil component 20 includes a connecting portion 40 of the flat wire. The connecting portion 40 interconnects the two coil elements 21 and 22. As illustrated in FIG. 4B, the connecting portion 40 of the coil component 20 is formed by extending the flat wire 30 radially outward by edgewise winding so that a part of the connecting portion 40 protrudes from the adjacent two faces 21*a* and 21*b* of the rectangular annulus of the coil element 21. Also, as illustrated in FIG. 5, the connecting portion 40 is formed by extending the flat wire 30 radially outward by edgewise winding so that a part of the connecting portions 40 protrudes from the adjacent two faces 22*a* and 22*b* of the rectangular annulus of the coil element 22.

As illustrated in FIG. 5, the connecting portion 40 of the coil component 20 includes a first bending line 41, a second bending line 42 and a third bending line 43. As illustrated in FIG. 3, at the first bending line 41, the connecting portion 40 is bent flatwise perpendicularly, i.e., at an angle of 90 degrees. At the second bending line 42 of FIG. 5, the connecting portion 40 is bent over flatwise as illustrated in FIGS. 3 and 4A. That is, at the second bending line 42, the connecting portion 40 is bent over at an angle of 180 degrees to form a turnover. At the third bending line 43 of FIG. 5, the connecting portion 40 is bent flatwise perpendicularly i.e., at an angle of 90 degrees as illustrated in FIG. 3. As used herein, the term "flatwise bending" refers to bending around the longer side of the longitudinal cross-sectional area of the flat wire.

Thus, by bending the connecting portion 40 at the three portions (at the bending lines 41, 42 and 43), including a turnover, the coil elements 21 and 22 are placed in parallel with each other so that their axes L1 and L2 are parallel (see FIG. 4A).

In FIGS. 3 and 4, the flat connecting portion 40 includes a first straight portion 51, a second straight portion 52, a third straight portion 53, a fourth straight portion 54, a fifth straight portion 55, a sixth straight portion 56 and a seventh straight portion 57.

The first straight portion 51 protrudes more radially outward (upward) than the outer surface of the first coil element 21, which is one of the coil elements 21 and 22. Specifically, in FIG. 4B, the first straight portion 51 extends from and over the left part of the first coil element 21, i.e., extends from and over the furthest part of the first coil element 21 from the second coil element 22.

The second straight portion 52 is formed by bending the flat connecting portion 40 perpendicularly in a flatwise way at the distal end of the first straight portion 51 to extend toward the first coil element 21 along the axial line L1 of the first coil element 21. The third straight portion 53 is formed by bending the flat connecting portion 40 perpendicularly in an edgewise way at the distal end of the second straight portion 52 to extend the second coil element 22, which is the other one of the coil elements 21 and 22. Specifically, in FIG. 4B, the third straight portion 53 extends toward the left part of the second coil element 22, the side of the second coil element 22 that is closest to the first coil element 21.

The fourth straight portion 54 is formed by bending the flat connecting portion 40 perpendicularly in an edgewise way at the distal end of the third straight portion 53 (the left side of the second coil element 22 in FIG. 4B) to extend in parallel with the second straight portion 52 along the axis line L2 of the second coil element 22. The fifth straight portion 55 is formed by bending the flat connecting portion 40 perpendicularly in a flatwise at the distal end of the fourth straight portion 54 to extend toward the lower side of the second coil element 22 in FIG. 4B.

The sixth straight portion 56 is formed by bending the flat connecting portion 40 perpendicularly in an edgewise way at the distal end of the fifth straight portion 55 (the lower side of the second coil element 22 in FIG. 4B) to extend toward the first coil element 21. The seventh straight portion 57 is formed by bending over the flat connecting portion 40 in a flatwise way at the distal end of the sixth straight portion 56 (at the position between the first coil element 21 and the second coil element 22) to extend toward the second coil element 22 to connect with the second coil element 22.

In the first coil element 21 of the coil component 20, one end 30*a* of the flat wire 30 protrudes upward (radially outward) for use as a connecting terminal. Similarly, in the second coil element 22, the other end of the flat wire 30 protrudes upward (radially outward) for use as a connecting terminal.

Next, a method for making the reactor 10 will be described.

At first, a method of forming the coil component 20 will be described.

As illustrated in FIG. 5, a single flat wire 30 having the rectangular cross-sectional area is wound in an edgewise way to form a plurality of coil elements 21 and 22 that have the same winding directions and that have rectangular annular configurations around a shared single axis. At the same time, the connecting portion 40 that is made of the flat wire that interconnects the consecutive coil elements 21 and 22 is formed by winding the flat wire 30 in an edgewise way so that the connecting portion 40 protrudes radially outward from the two adjacent faces 21*a* and 21*b* and the two adjacent faces 22*a* and 22*b* of the annular rectangular configuration of the coil elements 21 and 22. This is a process of edgewise winding.

Figure 6:
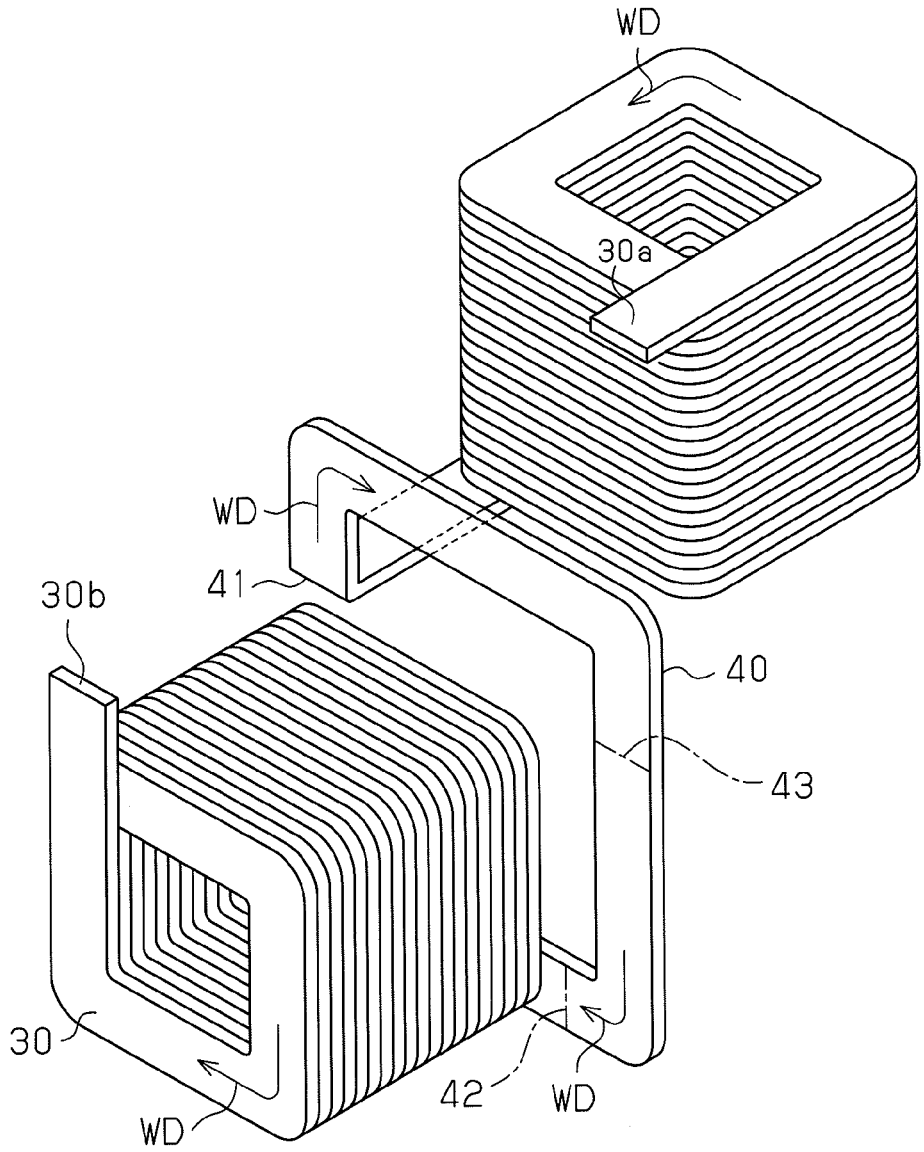
Figure 7:
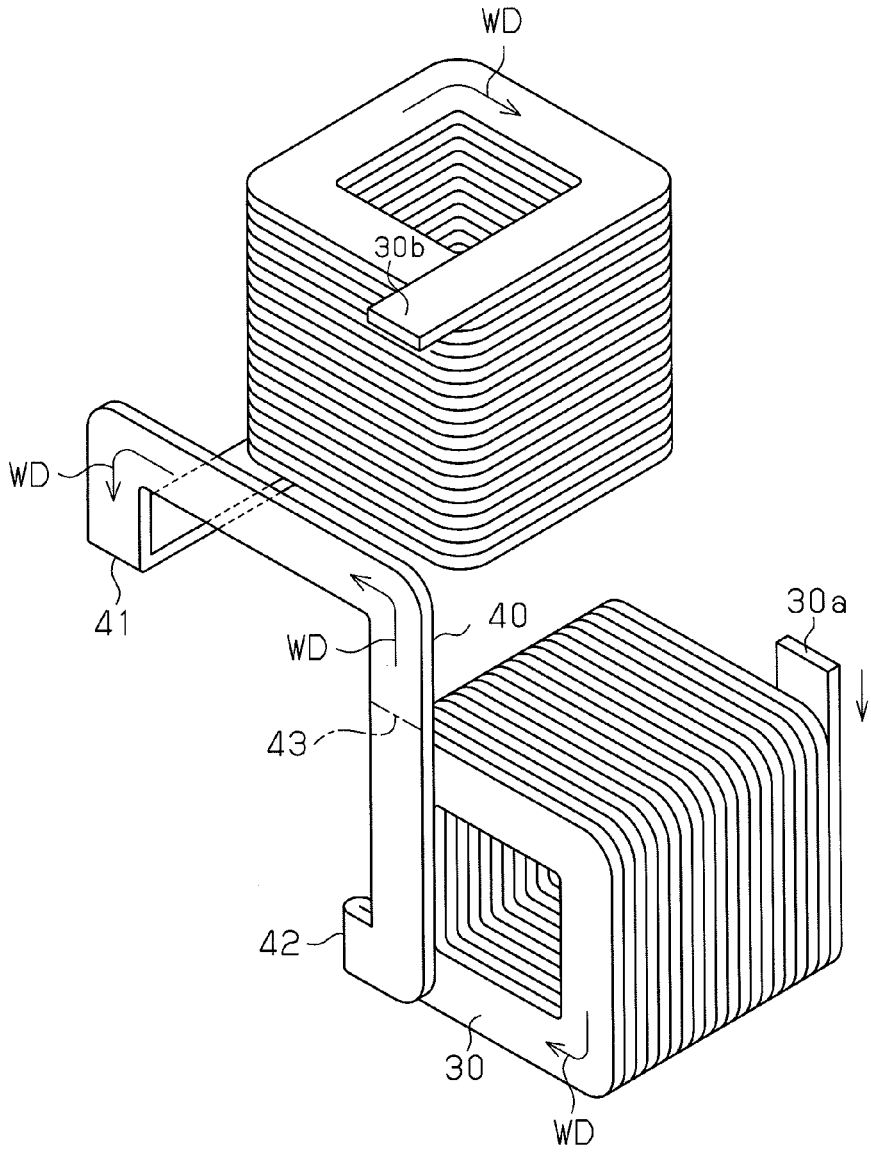

After the process of edgewise winding, as illustrated in FIG. 6, the connecting portion 40 is bent flatwise at the first bending line 41 at an angle of 90 degrees. Next, as illustrated in FIG. 7, the connecting portion 40 is turned over flatwise at the second bending line 42 at an angle of 180 degrees to form a turnover. Further, as illustrated in FIG. 3, the connecting portion 40 is bent flatwise at the third bending line 43 at an angle of 90 degrees. Thus, the connecting portion 40 is bent at the three portions (at the bending lines 41, 42 and 43), including a turnover, so that the coil elements 21 and 22 are placed in parallel with each other so that their axes L1 and L2 are parallel. This is a process of flatwise bending.

Thus, a process of flatwise bending is conducted at the three portions, including a turnover, in three steps. Subsequently, as illustrated in FIGS. 1 and 2, distal ends of the U-type cores 61 and 62 are inserted into the coil elements 21 and 22 to contact both end faces of the U-type cores 61 and 62.

As described above, two coil elements 21 and 22 at a time are wound around, only the size of an intermediate turn of the flat wire 30 is changed to make a connecting portion 40, and then the connecting portion 40 is bent three times in a flatwise manner. That is, an entire single wire 30 is bent edgewise around a single axis, and then the wire 30 is bent flatwise at three times to form completely a coil component 20 (coil elements 21 and 22). The size of the coil component 20 differs at the position of an intermediate turn, i.e., a portion that would form the connecting portion 40.

Accordingly, edgewise winding can be carried out at one time. In addition, the direction of edgewise winding does not need to be changed. Thus, the step is simplified and winding speed can be increased.

In more detail, if the two coil elements are formed by winding a single flat wire edgewise in a manner that two axes of the coil elements are offset as described in Japanese Patent No. 3737461, swing of winding at the time of coiling the flat wire becomes great. This makes increasing speed for making the coil difficult. On the other hand, the present embodiment enables increasing speed for making the coil because the coil elements are formed over a single axis.

In addition, in Japanese Laid-open Patent Publication No. 2007-305803, after winding of a first coil element is completed, all the straight flat wire is pulled out, and the flat wire is wound back to form a second coil element in an opposite direction. This is time-consuming due to the necessity for the time required for pulling out the flat wire. In addition, increasing speed is difficult since swing of the first coil element prevents smooth coiling of the second coil element. On the other hand, the present embodiment enables shortening the time due to no need for pulling out the flat wire as well as to increase speed due to formation of the two coil elements over a single axis. Further, since the winding directions of the coil elements are the same, the present embodiment needs only one kind of winding head whereas JP No. 2007-305803A needs two kinds of winding heads.

Interposition of a connecting portion between the two coil elements makes the size of a reactor greater due to the intervening space. To address this, in the present embodiment, a portion of the flat wire for the two coil element 21 and 22 is wound at a time while the size of an intermediate turn, or the connecting portion 40, is changed. Then, a process of flatwise bending is conducted at three times (one time at the bending line 41 at 90 degrees, one time at the bending line 42 at 180 degrees and one time at the bending line 43 at 90 degrees) for forming the finished product. Thus, the coil element 21 and the coil element 22 can be positioned in close with each other, which can make the size of the rector small.

The present embodiment has the following advantages.

(1) As structure for the coil component 20, a plurality of the coil elements 21 and 22 arranged side-by-side and having rectangular annular configurations are formed by winding a single flat wire 30 in an edgewise way. In forming the coil component 20, the connecting portion 40 of the flat wire 30 that bridges the coil element 21 and the coil element 22 is projected radially outward from the two adjacent faces 21*a*, 21*b*, 22*a*, 22*b* by edgewise winding. At this projected portion, the flat wire 30 is bent flatwise at the three positions (the bending lines 41, 42 and 43) including a turnover, so that the coil elements 21 and 22 are arranged in parallel with their axes L1 and L2 in parallel with each other.

The edgewise winding can be performed at one time. In addition, the connecting portion 40 between the coil elements 21 and 22 can be formed by flatwise bending at the three positions including a turnover. This facilitates the process. Consequently, a plurality of coil elements 21 and 22 are arranged in parallel and are formed by easily processing a single flat wire 30.

In addition, by winding the connecting portion 40 flatwise at the three positions including a turnover, the coil elements 21 and 22 are arranged side-by-side with their axes L1 and L2 in parallel with each other. The connecting portion 40 does not extend between the coil elements 21 and 22 in an intervening manner, i.e., the coil elements 21 and 22 can be arranged in proximity to each other.

(2) As structure for the reactor 10, a core (a UU-type core 60) is placed in the coil component 20. This facilitates processing of the core as well as miniaturization of a reactor.

(3) The method of forming the coil component 20 comprises a process of edgewise winding and a process of flatwise bending. In the process of edgewise winding, a single flat wire 30 is wound edgewise along one axis to form a plurality of coil elements 21 and 22 that are wound in the same directions and that have rectangular annular configurations. In addition, the connecting portion 40 that bridges or interconnects the two coil elements 21 and 22 is formed by winding the flat wire 30 edgewise to project radially outward from the two adjacent faces 21*a*, 21*b*, 22*a* and 22*b* of the coil elements 21 and 22. In the process of flatwise bending after the edgewise winding, the connecting portion 40 is bent flatwise at the three positions including a turnover, so that the coil elements 21 and 22 are arranged side-by-side with their axes L1 and L2 in parallel with each other. This results in the coil component of the item (1).

(4) Especially, a process of flatwise bending at the three positions comprises three separate steps. Thus, precise flatwise bending is ensured. In particular, forming a turnover at the second step among the three steps is advantageous.

Next, a second embodiment will be described with focusing on different points from the first embodiment.

Figure 8:
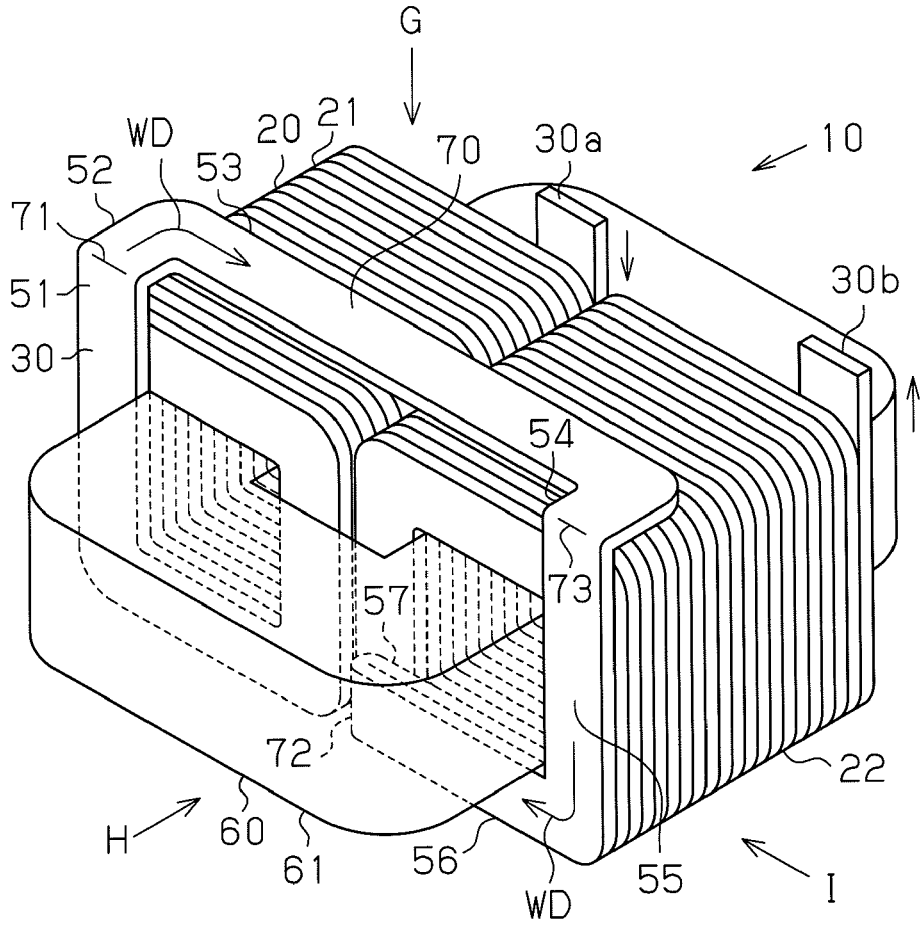
FIG. 8 is a perspective view of a reactor in accordance with a second embodiment.
Figure 9A:
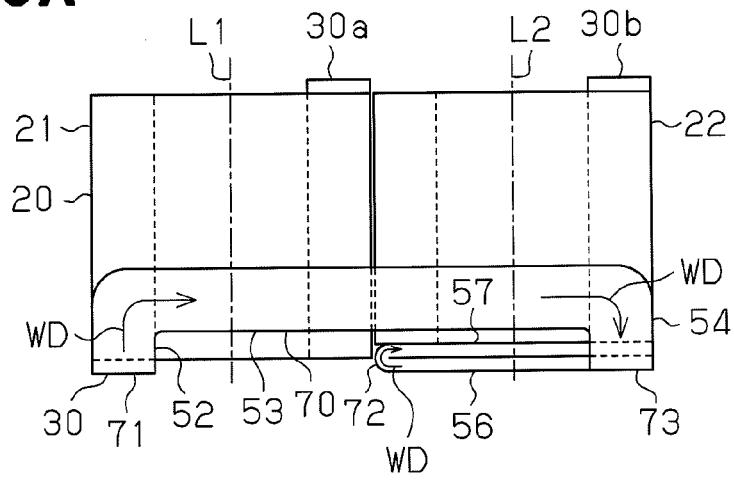
FIGS. 9A to C are a plan view, a front view, and a side view of a coil component of the second embodiment.

FIG. 8 illustrates a reactor of the second embodiment that is an alternative for the reactor of FIG. 1. FIG. 9 illustrates coil components of the second embodiment that is an alternative for the coil component of FIG. 4. FIG. 10 is a perspective view illustrating steps for forming the coil components that is an alternative for the steps in FIG. 5.

In FIG. 10, a connecting portion 70 of the coil component 20 includes a first bending line 71, a second bending line 72 and a third bending line 73. At the first bending line 71, the flat wire is bent flatwise perpendicularly (at 90 degrees) as illustrated in FIG. 8. At the second bending line 72 in FIG. 10, the flat wire is bent as illustrated in FIGS. 8 and 9A at 180 degrees to form a turnover. At the third bending line 73 in FIG. 10, the flat wire is bent flatwise perpendicularly (at 90 degrees) as illustrated in FIG. 8.

Also in this embodiment, the flat wire is bent flatwise at the three positions (the bending lines 71, 72, 73) including a turnover, so that the two coil elements 21 and 22 are arranged side-by-side with their axes L1 and L2 in parallel with each other (see FIG. 9A).

The first straight portion 51 of the connecting portion 70 extends over the left side of the first coil element 21, i.e., over the furthest side of the first coil element 21 from the second coil element 22 as in the first embodiment. The third straight portion 53 extends toward the right side of the second coil element 22 in FIG. 9B, i.e., toward the furthest side of the second coil element 22 from the first coil element 21.

Embodiments that fall within the scope of the inventions are not limited to the above embodiments but may include the following embodiments among others.

In FIG. 4B, the fifth straight portion 55 of the connecting portion 40 corresponds to the left side of the second coil element 22. Alternatively, the fifth straight portion 55 may correspond to the left side e.g., over the first coil element 21). This is preferred in placing the UU-type core 60 (the U-type core 61 and the U-type core 62) in the coil elements 21 and 22.

Figure 9B:
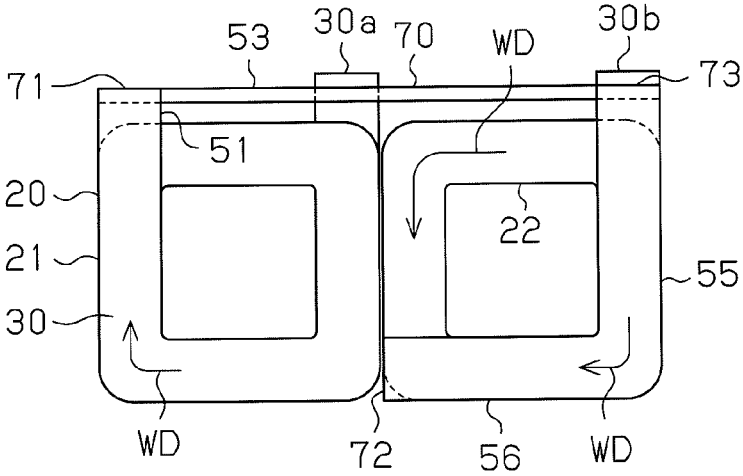
Figure 9C:
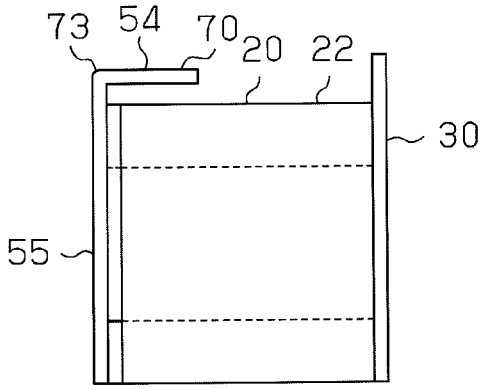
Figure 10:
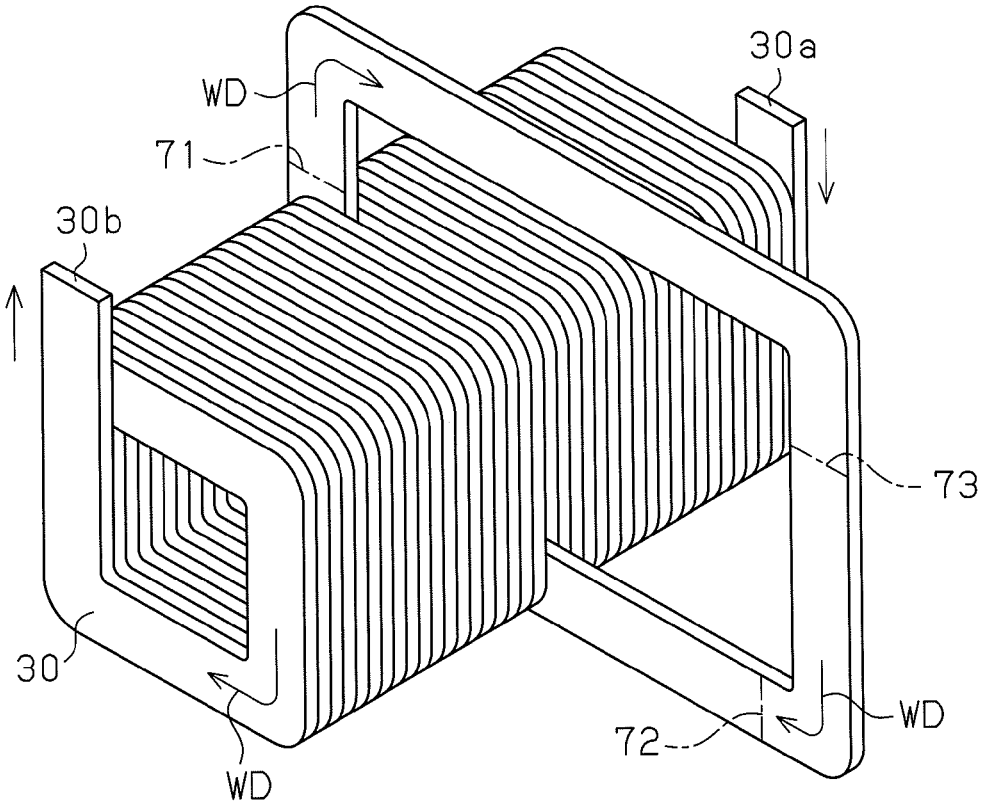
FIG. 10 is a perspective view illustrating steps for forming the coil component of the second embodiment.

In FIG. 9B, the fifth straight portion 55 of the connecting portion 70 corresponds to the right side of the second coil element 22. Alternatively, the fifth straight portion 55 may correspond to the right side. This is preferred in placing the UU-type core 60 (the U-type core 61 and the U-type core 62) in the coil elements 21 and 22.

The invention claimed is:

1. A coil component comprising a plurality of coil elements arranged side-by-side, wherein the plurality of coil elements are formed from a single flat wire wound edgewise so that the coil elements wind in the same direction and have rectangular annular configurations; and a connecting portion that interconnects the coil elements, wherein the connecting portion includes a portion of the flat wire between the two coil elements wound edgewise to protrude radially outward from two adjacent sides of the rectangular annular configurations of the coil elements, and bent flatwise at three positions including a turnover so that the two coil elements are arranged side-by-side with their axes in parallel with each other.

2. The coil component according to claim 1, wherein the coil elements include a first coil element and a second coil element, wherein the connecting portion includes:

a first straight portion that protrudes radially outward from the first coil element;

a second straight portion that is formed by bending the connecting portion flatwise perpendicularly at the distal end of the first straight portion to extend toward the first coil element along the axial direction of the first coil element;

a third straight portion that is formed by winding the connecting portion edgewise perpendicularly at the distal end of the second straight portion to extend from the first coil element to the second coil element;

a fourth straight portion that is formed by winding the connecting portion edgewise perpendicularly at the distal end of the third straight portion to extend in parallel with the second straight portion along the axial direction of the second coil element;

a fifth straight portion that is formed by bending the connecting portion flatwise perpendicularly at the distal end of the fourth straight portion to extend toward the second coil element;

a sixth straight portion that is formed by winding the connecting portion edgewise perpendicularly at the distal end of the fifth straight portion to extend a direction to approach the first coil element; and a seventh straight portion that is turned over by bending the connecting portion flatwise at the distal end of the sixth straight portion to extend toward the second coil element.

3. The coil component according to claim 2, wherein the first straight portion extends over the side of the first coil element that is furthest from the second coil element, wherein the third straight portion extends toward the side of the second coil element that is closest to the first coil element.

4. The coil component according to claim 2, wherein the first straight portion extends over the side of the first coil element that is furthest from the second coil element, wherein the third straight portion extends toward the side of the second coil element that is furthest to the first coil element.

5. A reactor comprising a coil component according to claim 1 and a core placed in the coil component.

6. A method for forming a coil component comprising:

winding a flat wire edgewise around a single axis so that a plurality of coil elements are formed and wound in the same direction having rectangular annular configurations and a connecting portion interconnecting the two coil elements protrudes radially outward from two adjacent sides of the rectangular annular configurations of the coil elements; and after winding the flat wire edgewise, bending the connecting portion flatwise at three positions including a turnover so that the two coil elements are arranged side-by-side with their axes in parallel with each other.

7. The method according to the claim 6 wherein bending the connecting portion flatwise comprises bending the connecting portion flatwise at the three positions in three steps.

8. The method according to claim 7 wherein a second step of said three steps comprises a step of forming a turnover.

* * * * *